US005472461A

United States Patent [19]

Li

[11] Patent Number: 5,472,461

[45] Date of Patent: Dec. 5, 1995

[54] VITRIFIED ABRASIVE BODIES

[75] Inventor: Rounan Li, Shrewsbury, Mass.

[73] Assignee: Norton Company, Worcester, Mass.

[21] Appl. No.: 184,818

[22] Filed: Jan. 21, 1994

[51] Int. Cl.[6] ..... B24D 3/34

[52] U.S. Cl. ..... 51/296; 51/307; 51/308; 51/309

[58] Field of Search ..... 51/307, 308, 309, 51/296

[56] References Cited

U.S. PATENT DOCUMENTS

| | | | |
|---|---|---|---|
| 1,986,850 | 1/1935 | Pohl et al. | 51/278 |
| 2,806,772 | 9/1957 | Robie | 51/296 |
| 2,986,455 | 5/1961 | Sandmeyer | 51/296 |
| 4,157,897 | 6/1979 | Keat | 51/295 |
| 4,543,107 | 9/1985 | Rue | 51/309 |
| 4,799,939 | 1/1989 | Bloecher et al. | 51/293 |
| 5,094,672 | 3/1992 | Giles et al. | 51/309 |
| 5,095,665 | 3/1992 | Nagata et al. | 51/307 |
| 5,125,933 | 6/1992 | St. Pierre | 51/295 |
| 5,203,886 | 4/1993 | Sheldon et al. | 51/309 |

FOREIGN PATENT DOCUMENTS

| | | | |
|---|---|---|---|
| 485966A2 | 5/1992 | European Pat. Off. | B24D 3/18 |
| 543581A1 | 5/1993 | European Pat. Off. | C04B 38/08 |
| 55-137885 | 10/1980 | Japan | B24D 3/14 |

*Primary Examiner*—Deborah Jones

*Attorney, Agent, or Firm*—Brian M. Kolkowski; Mary E. Porter

[57] ABSTRACT

Improved hot-pressed vitrified bodies are described, which comprise an abrasive material, a vitreous bond; and at least one extender agent. The extender agent may be formed of hollow ceramic bodies such as glass or mullite spheres, alone or in combination with a non-reactive material such as graphite. An improved method for preparing vitrified abrasive wheels is also described.

20 Claims, 1 Drawing Sheet

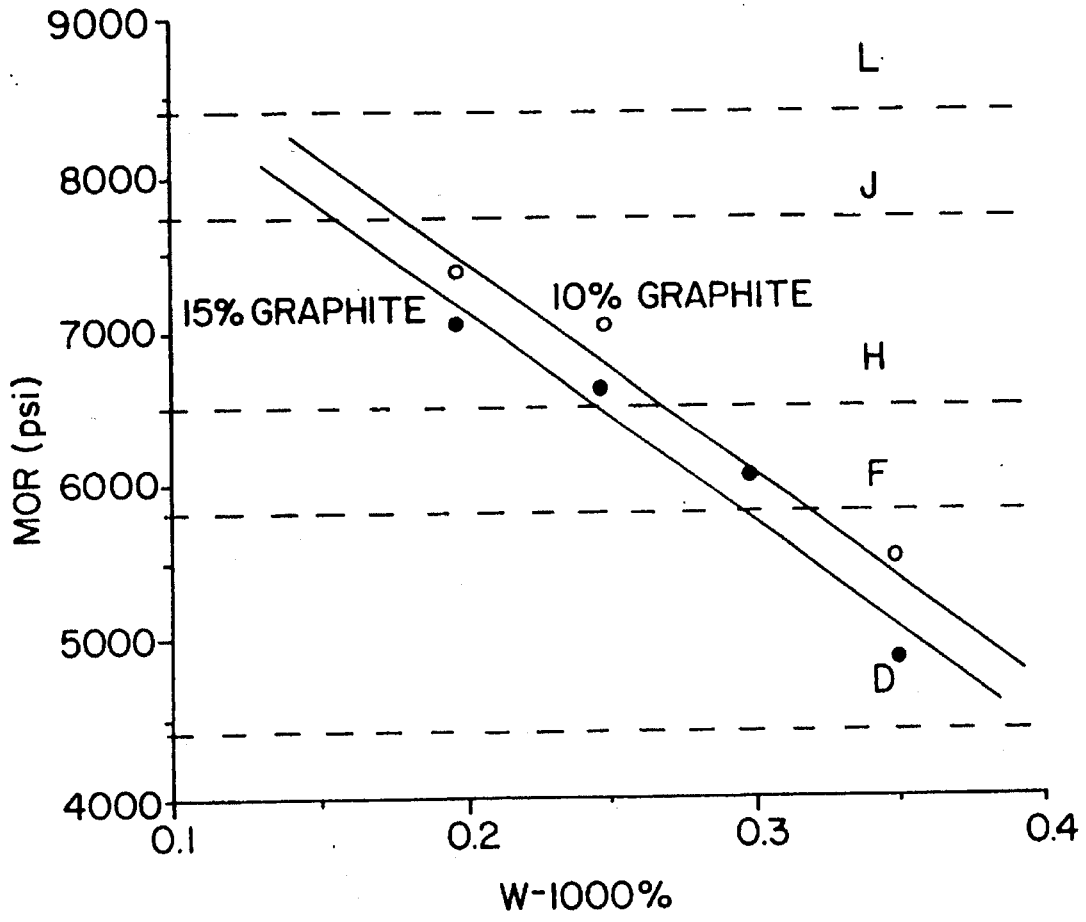
9000
8000
7000
6000
5000
4000
MOR (psi)
L
J
H
F
D
15% GRAPHITE
10% GRAPHITE
0.1
0.2
0.3
0.4
W-1000%

VITRIFIED ABRASIVE BODIES

TECHNICAL FIELD

This invention generally relates to bonded abrasive bodies, and more specifically, to vitrified abrasive grinding tools prepared by hot pressing techniques.

BACKGROUND OF THE INVENTION

The performance of a grinding tool is determined mainly by the constituent materials used to prepare the tool. As an example, the grinding action and tool life of a vitrified grinding wheel are controlled primarily by the mount of abrasive and bond present, as well as the degree of porosity. For a given amount of abrasive, low porosity and high bond content result in hard action and long tool life. Conversely, high porosity and low bond content result in "softer" action, i.e., lower grinding power, and comparatively shorter tool life. The final porosity in conventional, cold-pressed grinding tools is controlled by varying the bond/abrasive ratio, as well as the density achieved in the cold-pressing step.

A useful technique for preparing vitrified grinding tools is hot pressing, which usually involves the simultaneous application of heat and pressure to the shaped material in a die. This technique can advantageously be used to obtain a very dense vitrified material at comparatively low molding pressures, e.g., 0.7 to 1.5 tons per square inch (tsi). While the resulting product often has a long working life, it may be deficient in some respects. For example, the product is limited to one grade of grinding ability or hardness, i.e., a hard grade characteristic of very low porosity (e.g., 0% to 5%). As a consequence, the product is "hard acting", i.e., its cutting surface will not break down readily. The hard-acting characteristic can unfortunately lead to unsuitable grinding, since the abrasive particles tend to dull and stop cutting; and the wheel faces tend to load. Furthermore, because of its relatively low viscosity, the glass portion of the dense, vitrified product may collapse under the pressure and temperature conditions utilized in hot pressing.

Efforts to reduce the density of abrasive materials by way of porosity inducement have been undertaken in the past. As an example, U.S. Pat. No. 1,986,850 of Pohl et al describes grinding bodies having a cellular structure, in which porosity is achieved via the formation of gasses when constituents within the body react with each other. In such a process, however, porosity of controlled size and distribution is often difficult to obtain.

U.S. Pat. No. 2,806,772 of Robie teaches the incorporation of thin-walled hollow spheres into phenolic-matrix abrasive materials. The spheres may be made from clay or various resins and plastics. The Robie invention appears to rely on cold pressing techniques, which often may not permit good control over the porosity and hardness of abrasive tools.

U.S. Pat. No. 2,986,455 of Sandmeyer also teaches the use of hollow spherical or globular abrasive particles to prepare porous grinding wheels. While Sandmeyer discloses hot pressing techniques, the reference does not appear to contemplate vitrified wheels in which porosity can be very accurately controlled over a wide range.

U.S. Pat. No. 4, 157,897 of Keat describes ceramic-bonded grinding tools which contain diamond or cubic boron nitride abrasive grits. The matrix bond includes either natural or synthetic graphite. Keat requires very low porosity in the matrix, i.e., less than 10%.

U.S. Pat. No. 4,799,939 of Bloecher et al describes abrasive products which include hollow glass bodies in an erodable matrix. The invention of Bloecher appears to be directed primarily to coated abrasives, and not to vitrified abrasive bodies such as cutting wheels.

U.S. Pat. No. 5,203,886 of Sheldon et al describes high porosity vitrified bonded grinding wheels, prepared by the use of bubbled alumina beads and particles of an organic pore-inducing material such as graphite, nut shells, or wood particles. Like Robie, however, Sheldon appears to rely on a cold-pressing technique, with its attendant disadvantages in some circumstances.

In view of the state of the art and some of the above-described drawbacks in that art, it is apparent that a need exists for hot-pressed, vitrified abrasive materials with improved grinding capabilities and adjustable grade characteristics. As a specific example, a need still exists for hot-pressed vitrified grinding wheels which are freer-cutting under a variety of working conditions.

It's also apparent that better methods for selectively varying the porosity (and consequently, the hardness characteristics) of hot-pressed vitrified materials need to be developed.

SUMMARY OF THE INVENTION

In view of the needs discussed above, improved hot-pressed vitrified abrasive bodies have been discovered. These materials comprise:

(a) an abrasive material;

(b) a vitreous bond; and (c) an extender agent selected from the group consisting of:

(I) at least one type of hollow ceramic body (c(i)); and (II) a combination of component c(i) with at least one nonreactive material having a low coefficient of friction, which is not hollow (c(ii)).

The porosity of these abrasive bodies is in the range of about 1% to about 50%, based on volume. As described below, the use of these materials results in much-improved tool performance as compared to tools prepared from cold-pressed materials of the prior art.

An additional embodiment of this invention is directed to an improved method for preparing an abrasive body. The method includes the steps of combining an abrasive material, a vitreous bond, and the extender agent described above into a desired form, and then thermally treating the formed mixture by a hot pressing technique.

BRIEF DESCRIPTION OF THE DRAWING

The Figure depicts modulus and porosity characteristics for a variety of samples based on the present invention.

DETAILED DESCRIPTION OF THE INVENTION

The abrasive material of component (a) may be either a conventional abrasive, a superabrasive, a sol gel alumina abrasive, or a mixture of any of these materials. The total amount of abrasive material present will usually be about 4 to about 56 volume % of the abrasive body. In some preferred embodiments, this range will be from about 30 to about 48 volume %.

Conventional abrasives are well-known in the art, and include, for example, alumina, silicon carbide, zirconia-alumina, garnet, emery, and flint. Superabrasives are also known in the art. Examples are diamond and cubic boron nitride (CBN).

The sol-gel alumina abrasive bodies can be seeded or unseeded. The aluminous bodies are prepared by a sol-gel technique which entails crushing or extruding, and then firing a dried gel prepared from a hydrated alumina such as microcrystalline boehmite, water, and an acid such as nitric acid. The initial sol may further include up to 10–15% by weight of spinel, mullite, manganese dioxide, titania, magnesia, ceria, zirconia powder or a zirconia precursor which can be added in larger amounts. These additives are normally included to modify such properties as fracture toughness, hardness, friability, fracture mechanics, or drying behavior. In its most preferred embodiment, the sol or gel includes a dispersed submicron crystalline seed material or a precursor thereof in hydrated alumina particles to alpha alumina upon sintering. Suitable seeds are well-known in the art. The amount of seed material should not exceed about 10 weight % of the hydrated alumina, and there is normally no benefit to amounts in excess of about 5%. If the seed is adequately fine (preferably about 60 $m^2$ per gram or more), amounts of from about 0.5 to 10% may be used, with about 1 to 5% being preferred. The seeds may also be added in the form of a precursor such as ferric nitrate solution. In general, the seed material should be isostructural with alpha alumina and have similar crystal lattice dimensions (within about 15%), and should be present in the dried gel at the temperatures at which the conversion to alpha alumina occurs (about 1000° C. to 1100° C.). The preparation of suitable gels, both with and without seeds, is well-known in the art, as are the processing procedures, such as crushing, extruding, and firing. Thus, further details thereon are readily available in the literature and are not included here.

Each aluminous body so prepared is made up essentially of numerous alpha alumina crystals having crystal sizes of less than about 10 micrometers, and preferably less than about 1 micrometer. The abrasive has a density of at least about 95% of theoretical density.

The average particle size of grains (sometimes referred to as "grits") of the abrasive material depends on a variety of factors, such as the particular abrasive utilized, as well as the end use of tools formed from the abrasive body. In general, an average particle size for superabrasives is in the range of about 0.5 to 500 micrometers, and preferably, in the range of about 2 to 200 micrometers. The average particle size for conventional abrasives is usually in the range of about 0.5 to 500 micrometers. The average dimension of sol gel alumina crystals is described above. Those of ordinary skill in the art will be able to select the most appropriate abrasive particle size for a desired application without undue experimentation.

Any conventional vitreous bond composition can be used for component (b) of this invention. Many of them are referred to as "glass frits." Vitreous bonds are described, for example, in the above-mentioned U.S. Pat. No. 5,203,886 of Sheldon et al, incorporated herein by reference. A variety of commercial sources exist for such bonds. Exemplary suppliers include Ferro Corporation and Etes L'Hospied of Valluria, France.

The amount of bond employed for a particular abrasive product depends on its intended use. Generally, about 5 to 55 volume % will be used, with a preferable range being about 15 to about 45 volume %. Depending on the actual density of each of the constituents used to form the abrasive products, these amounts of bond correspond to about 10 to about 45 wt. % of the mix from which the product is formed and fired.

The abrasive bodies of this,invention include, as component (c), the extender agent mentioned above. The term "hollow ceramic body" for component c(i) is intended herein to include both vitreous and crystalline phases. One preferred extender of this type, mullite, is a crystalline material having the approximate formula $3Al_2O_3 \bullet 2SiO_2$, which contains about 72 weight % $Al_2O_3$. Natural mullite is available, but synthetic mullite is more commonly used, and can be prepared by heating a mixture of pure $Al_2O_3$ or bauxite with clay or sillimanite.

Mullite as used for component c(i) must be in the form of hollow bodies. As used herein, the term "hollow" means having an empty space or cavity within a wall that is substantially impermeable to liquids. The hollow bodies may be of any shape, e.g., cylindrical, pyramidal, cubical, or bead-shaped, but are preferably spherical particles having a thin wall enclosing a void. The term "spherical" as used herein means having a spherical or spheroidal shape.

The size of the hollow bodies varies considerably. In the case of mullite spheres, the average diameter ranges from about 2 micrometers to about 400 micrometers, and is preferably in the range of about 50 micrometers to about 150 micrometers. The bulk density of hollow mullite bodies employed in this invention usually ranges from about 0.7 g/cc to about 0.8 g/cc, as measured by a gas pycnometer, model number SPY3. The bulk density value is determined by dividing the weight of the hollow bodies by the actual volume of the hollow bodies.

The hollow mullitc bodies should have a certain amount of crush resistance. The crush strength should be high enough to prevent collapse of the mullite bodies during preparation of the abrasive body, but low enough to allow for some erosion during use of the abrasive body. The crush strength of the mullite bodies should be in the range of about 2000 psi to about 5000 psi.

The spherical type of mullite is frequently referred to as "bubbled" mullite. It is commercially available from Zeelan Industries in the form of a silica-alumina ceramic product, e.g., Z●Light Spheres®, grade W-1000. Typically, these commercial materials contain from about 30 volume % to about 40 volume % actual mullite.

Hollow glass bodies may also be used as the extender agent for component c(i). The use of glass bodies, which have a lower compressive strength than mullite, sometimes promotes a higher degree of free cutting for abrasive bodies of the present invention. Breakdown of the glass material at the cutting surface reduces friction. Furthermore, the presence of glass bodies tends to minimize the generation of power spikes after the cutting tool is trued.

Any type of glass is suitable for this invention, as long as it is sufficiently stable and does not react with either the other abrasive tool constituents or the working material. Glass which contains an excessive amount of alkali oxides may result in corrosion of the workpiece, especially if an aqueous fluid is used as a coolant during cutting or grinding operations. Borosilicate glass is very suitable for this invention.

The shape of the glass used is not critical, and can be any of the types commonly available, e.g., beads or rods, for example. In preferred embodiments, the glass is in the form of hollow spheres or bubbles. Exemplary glass spheres are described in the above-mentioned U.S. Pat. No. 4,799,939 of Bloecher et al, incorporated herein by reference. A commercial example is the Q-CEL® type of hollow microspheres, available from PQ Corporation of Valley Forge, PA, e.g., grades 636 and 640.

When glass spheres are employed, their average diameter is usually in the range of about 10 micrometers to about 200 micrometers, and preferably, in the range of about 30 micrometers to about 100 micrometers. The bulk density of the spheres usually ranges from about 0.4 g/cc to about 0.5 g/cc. The glass spheres should have a maximum working pressure high enough to prevent crushing during fabrication and use of the abrasive body, and to thereby retain enclosed porosity. The maximum working pressure is usually in the range of about 1000 psi to about 3500 psi.

The present invention permits the use of relatively thin glass sphere wall thicknesses, as compared to glass used in compositions of the prior art. Thin glass walls have the advantage of allowing more enclosed porosity without having to use a greater number of spheres. Furthermore, unlike the cold pressing techniques prevalent in the past, hot pressing does not require the high molding pressures which tended to crush thin-walled glass spheres.

The amount of hollow ceramic bodies (component c(i)) employed will depend on several factors, such as the types of abrasive and bond present; the particular ceramics used; the type and amount (if any) of the other extender, component c(ii); as well as the degree of porosity required for tools made with the abrasive body. In general, a grinding wheel formed from an abrasive/bond mixture for this invention will usually comprise about 2 to about 20 volume % ceramic bodies, and more preferably, about 4 to about 15 volume % bodies.

The level of component c(i) is also related to the amount of vitreous bond in the abrasive body, since enough bond must be present to substantially wet the ceramic bodies. Thus, the amount of c(i) present is generally in the range of about 2 to about 50 volume %, based on the total volume of component (b) and component c(i), with a preferred level being about 4 to about 20 volume %. Those of ordinary skill in the art of ceramic grinding materials will be able to select the most appropriate level of ceramic bodies without undue experimentation.

In preferred embodiments, either mullite or glass is individually used as the sole constituent for component c(i). However, it is also possible to use combinations of these two ceramic bodies. In such an instance, the volume ratio of hollow mullite bodies to hollow glass bodies ranges from about 99:1 to about 1:99.

Although component c(i) may be used as the sole extender agent for the hot-pressed abrasive bodies of this invention, some embodiments involve the use of c(i) in combination with component c(ii). This second component is a non-reactive, stable material having a low coefficient of friction, i.e., characteristic of a solid lubricant. "Non-reactive" as used herein refers to a lack of substantial reactivity with the abrasive, bond, or other filler components in the abrasive body.

Unlike the extender agents of c(i), component c(ii) is not hollow. Component c(ii) is also a good thermal conductor as compared to some of the other components in the abrasive body. Examples of c(ii) are graphite, hexagonal boron nitride (sometimes referred to as "white graphite"), molybdenum disulfide, and various mixtures of any of the foregoing. The particle size of component c(ii) will usually be less than about 200 micrometers (numerical average particle diameter).

The preferred material for component c(ii) is graphite, described, for example, in the above-mentioned U.S. Pat. 4,157,897, incorporated herein by reference. Graphite occurs naturally, but can also be prepared synthetically by heating petroleum coke at high temperatures in an electric resistance furnace. The use of graphite in various forms is possible, e.g., powder, crystals, flake, rods, plates, or fibers.

In the case of graphite, preferred particle sizes within the broad range mentioned above depend upon both the abrasive grit size and the end use application for the abrasive body. As an example, when using a fine-grit diamond abrasive to grind diamond films or ceramic inserts, a preferred graphite particle size is in the range of about 1 to about 10 micrometers. When grinding steel with an abrasive material like CBN, a preferred graphite particle size is usually in the range of about 75 to about 150 micrometers.

Graphite and the other c(ii) materials described above are especially useful for abrasive bodies of the present invention because they neither react with nor are wet by the bond material. Furthermore, these materials are good lubricants, and generally improve the grinding characteristics of the abrasive bodies.

The level of component c(ii) depends on many of the factors mentioned for component c(i), and on the degree of lubricity required for the abrasive body. In general, the amount of c(ii) is in the range of about 1 to about 50 volume %, based on the total volume of vitreous bond (component b) and c(ii), with a preferred level being about 4 to about 30 volume %. The most appropriate level of component c(ii) for a given end use can be determined without undue experimentation, based on the factors discussed above.

As described in U.S. Pat. No. 4,157,897, a portion, e.g., up to about 50% by volume, of the graphite or graphite-type material of component c(ii), may be substituted with a metal powder such as silver, copper, aluminum, or tin. The metal should be finely particulate, in the range of sizes specified for graphite.

The abrasive bodies of this invention can also include at least one additional filler. (Some of these materials are sometimes alternatively referred to in the art as "abrasives"). Examples are silicon carbide, alumina, solid mullite, fumed silica, sol gel materials, and titanium dioxide. Another suitable filler is boron suboxide. Various types of this material are available; some are described in U.S. Pat. No. 5,135,892, incorporated herein by reference. The effective amount for each additional filler can readily be determined by those of ordinary skill in the art.

As mentioned above, the vitrified abrasive bodies of this invention are prepared by hot pressing. This technique is known in the art and described, for example, in U.S. Pat. Nos. 4,157,897 and 2,986,455, the last-mentioned patent also being incorporated herein by reference. Hot-pressing is also described in Kirk-Othmer's *Encyclopedia of Chemical Technology,* 3rd Ed., 1979, p. 263; and in the *Encyclopedia of Materials Science and Engineering*, Vol. 3, Pergamon Press Ltd., 1986, pp. 2205–2208. As an example, a grinding wheel can be prepared by, first, mechanically blending the vitreous bond, the abrasive, the extender agent of this invention, along with any other additives. The mixture can be screened to remove and break up any agglomerates which may have formed during blending.

The mixture is next placed in an appropriate mold, usually made of graphite. Shaped plungers are usually employed to cap off the mixture. The loaded mold assembly is then typically placed in any appropriate furnace, e.g., a resistance- or induction-type unit. An inert gas like nitrogen may be introduced to minimize oxidation of the mold.

The specific temperature, pressure and time ranges will depend on the specific materials employed (e.g., bond type), the type of equipment in use, and the dimensions of the wheel. At room temperature, the mold is usually taken up to an initial pressure sufficient to hold the mold assembly together, over the course of about 3 minutes to about 30 minutes, although it is also possible to proceed directly to the temperature and pressure levels appropriate for the pressing stage. The pressing temperature is typically in the range of about 550° C. to about 1000° C.; and preferably, from about 650° C. to about 800° C. The final molding pressure will usually range from about 0.7 tsi to about 1.5 tsi.

The holding time within the mold under the final temperature and pressure conditions will range from about 3 minutes to about 20 minutes, and preferably, from about 4 minutes to about 10 minutes.

The wheels are then usually stripped from the mold and air-cooled. In a later step, the fired wheels can be edged and finished according to standard practice, and then speed-tested prior to use. It should be understood that another aspect of this invention is directed to a grinding tool prepared by the method described above.

For the purpose of this disclosure, the scope of the term "hot pressing" includes hot coining procedures, which are known in the art. In a typical hot coining procedure, pressure is applied to the mold assembly after it is taken out of the heating furnace.

The versatility of the hot-pressed abrasive bodies of this invention results from the ability to very closely control their porosity. In the case of abrasive wheels, the consistency from sample-to-sample is often greater than that achieved with the cold-pressed wheels of the prior art. Such an attribute can in turn result in enhanced productivity on a commercial scale.

The abrasive bodies of this invention are very suitable for grinding all types of metal, e.g., various steels such as stainless steel, cast steel, hardened tool steel, cast irons, ductile ion, malleable iron, spheroidal graphite iron, chilled iron, and modular iron, as well as metals like chromium, titanium, aluminum, and high strength alloys typically used in the aerospace industry. They are also very suitable for grinding diamond materials and ceramics such as tungsten carbide. Those of skill in the art understand that the abrasive bodies of this invention, like all such materials, will be more effective in grinding some materials than others.

The following examples are provided to more fully describe this invention. They should be considered as illustrative of the invention, rather than limiting what is otherwise disclosed and claimed herein. All parts and percentages are by volume unless otherwise specified.

EXAMPLES

Example 1

This examples demonstrates the degree of grade control in hot-pressed bodies of the present invention. A series of test pieces were prepared, utilizing the following materials:

Cubic Boron Nitride (CBN): grade BZN1, 100 grit size, available from General Electric Company.

Sol Gel (SG): alumina grade, 90 grit size, available from Norton Company.

Graphite (Gr): grade 4434, Asbury Graphite Mills, Inc., having a particle size distribution in which 76.2 wt. % of the particles were between 200 mesh and 325 mesh, and 20.8 wt. % of the particles were above 325 mesh.

Mullite: Bubbled form, blight Spheres®, grade W-1000.

Bond: Powdered glass frit from Ferro Corporation, average particle size of about 20 micrometers, having the following composition:

| Component | Wt. % |
|---|---|
| $SiO_2$ | 66.00 |
| $Al_2O_3$ | 5.25 |
| $B_2O_3$ | 22.15 |
| CaO | 1.50 |
| MgO | 0.10 |
| $Na_2O$ | 5.00 |

The amount of each material in each sample is indicated in Table 1. Various levels of graphite and mullite are utilized; their amounts are based on the amount of bond present.

TABLE 1

| | Sample # | | | | | | | |
|---|---|---|---|---|---|---|---|---|
| | 1 | 2 | 3 | 4 | 5 | 6 | 7 | 8 |
| CBN[a] | 43.8 | 43.8 | 43.8 | 43.8 | 43.8 | 43.8 | 43.8 | 43.8 |
| SG[b] | 4.25 | 4.25 | 4.25 | 4.25 | 4.25 | 4.25 | 4.25 | 4.25 |
| Gr[c] | 6.4 | 6.0 | 5.7 | 5.3 | 4.2 | 4.0 | 3.7 | 3.5 |
| W1000[d] | 9.1 | 11.5 | 13.9 | 16.3 | 9.6 | 12.0 | 14.5 | 17.0 |
| Bond[e] | 36.5 | 34.5 | 32.4 | 30.4 | 38.2 | 36.0 | 33.8 | 31.5 |
| G/G + B* | 15% | 15% | 15% | 15% | 10% | 10% | 10% | 10% |
| W/W + B** | 20% | 25% | 30% | 35% | 20% | 25% | 30% | 35% |

[a]cubic boron nitride;
[b]sol gel;
[c]graphite;
[d]bubbled mullite;
[e]vitrified bond;
*volume percent of graphite as percentage of (graphite + bond);
**volume percent of mullite as percentage of (mullite + bond).

The procedures for preparing test pieces and hot pressing them were similar in many respects to the procedures outlined in U.S. Pat. No. 4,157,897 of Keat. In the present example, the materials were mixed by stirring in a beaker and then screening through a metal, 72 mesh screen. They were then placed in a graphite mold of suitable design to yield fired pieces having the following dimensions: ¼" width×¼" length×2½" thickness.

The loaded mold assembly, which contained four samples, was placed in an induction-type furnace. A small initial pressure of about 0.5 tsi was applied, and the temperature was then increased to about 780° C. When that temperature setting was reached, the pressure was increased to about 1.5 tsi., and the assembly was maintained under those conditions for about 4 minutes. The assembly was then cooled to about 500° C., and the pressure was released. The run was then terminated, and the test samples were stripped from the mold and air-cooled.

The modulus of rupture was measured for each of the test pieces, utilizing an Instron device, model 4204, 3-point method. In general, modulus is proportional to grade and porosity, i.e., a higher modulus indicates a higher grade and lower porosity.

The figure depicts modulus of rupture as a function of mullite and graphite levels. Each of the data points in the figure is the result of averaging the modulus values for two identical samples corresponding to each sample in Table 1. The grade levels indicated in the figure (L, J, H, F, and D) are based on the following specification:

B: 100 grit size; 175 concentration; VX(vitrified bond).

The figure demonstrates that the grade and porosity of hot-pressed abrasive bodies of this invention can be controlled by varying the content of the bubbled mullite and graphite contained therein. This type of control—by varying constituent levels—cannot be obtained in the cold-pressed abrasive bodies described in the prior art, which usually require substantial process changes to vary porosity and grade.

Example 2

This example involves a comparison between grinding wheels that have been cold-pressed with those that have been hot pressed, and which contain the extender agent of the present invention. All of the wheels were of the 1A1 type.

Sample 1 was a cold-pressed composition which contained 43.8 vol. % CBN, grade BZN 1. The sample also contained 22 vol. % of the bond used in example 1, and 4.25 vol. % of the sol gel material used in example 1. The sample was prepared by blending the mixture for a total of about 10 minutes, screening the blend to remove any agglomerates; and then molding the blended mixture at room temperature with a hydraulic press to form the wheel, which was about 3" in diameter and 0.625" thick.

The wheel was then air-dried and fired to 950° C. in air for about 12 hours, followed by 4 hours soaking (in hot air) at 950° C., before being allowed to cool to room temperature. The final wheel contained approximately 30 vol. % porosity.

Sample 2 was a hot-pressed wheel prepared from a composition which contained about 43.8 vol. % of the CBN used in example 1; about 4.3 vol. % of a secondary abrasive, i.e., the sol gel material used in example 1; about 32.7 vol. % of the bond used in example 1; about 8.5 vol. % bubbled mullite, W-1000; and about 5.8 vol. % graphite, grade 4434.

A mold assembly similar to that used in example 1 was employed here, although it was adapted for making wheels. The total assembly was heated to a control temperature of about 870° C., which corresponded to a wheel temperature of about 720° C. to 760° C., and stabilized for 7 minutes. After that time, a pressure of 0.7 tsi was applied for 5 minutes. The furnace was then shut down while the pressure was maintained. When the control temperature decreased to about 700° C., the wheel was stripped from the mold and air-cooled for testing. The final wheel contained about 2–5 vol. % porosity.

Sample 3 had a composition similar to that of sample 2, except that 4.3 vol. % of silicon carbide was substituted for the sol gel as the secondary abrasive. A wheel based on this material was prepared in the same manner as sample 2.

The grinding machine was a Heald CF1 model. The following operating parameters were in effect:

Wheel Speed: 8000 sfpm
Material Ground: 52100 bearing steel
Operation: Wet Grinding
MRR (material removal rate): 1.2 $in^3$/min●in.
Grinding Mode: Cylindrical, external and internal grinding.

In Table 2, "waviness" is a measure of surface roughness. It was measured with a Surfanalyzer System 5000, sold by Federal. "G-Ratio" represents the total volume of material ground divided by the total volume of wheel wear. Higher G-ratio values indicate longer life for the wheel. The "power" value represents the power drawn in grinding, and is measured with a Power Cell device, made by Load Controls Company.

The following results were obtained:

TABLE 2

| | Waviness[a] | G-Ratio[b] | Power[c] |
|---|---|---|---|
| OD Mode* | | | |
| Sample 1 (CP)** | 61 | 499 | 17.5 |
| Sample 2 (HP)** | 29 | 577 | 17.4 |
| Sample 3 (HP) | 94 | 519 | 15.0 |
| ID Mode* | | | |
| Sample 1 (CP) | 75 | 622 | 21 |
| Sample 2 (HP) | 33 | 833 | 27 |
| Sample 3 (HP) | 28 | 1472 | 27 |

[a]measured in micro-inches;
[b]final value;
[c]horsepower/in.
*"OD" = outer diameter of workpiece;
"ID" = inner diameter of workpiece.
**"CP" = cold-pressed;
"HP" = hot-pressed.

The data of Table 2 demonstrate smoother workpiece surfaces when using the hot-pressed wheels of the present invention, except in the case of using sample 3 on the outer diameter-surface of the workpiece.

The G-Ratio is an important characteristic for grinding wheels, and Table 2 demonstrates very improved values for the hot-pressed compositions of samples 2 and 3. This characteristic corresponds to longer working life for grinding wheels of the present invention.

Example 3

In this example, the performance of a grinding wheel based on the present invention is compared to a wheel containing only graphite as the extender agent.

Sample 1, based on the present invention, was a hot-pressed wheel prepared from a composition which contained about 43.8 vol. % of the CBN used in example 1; about 4.3 vol. % of a secondary abrasive, i.e., the sol gel material used in example 1; about 32.7 vol. % of the bond used in example 1; about 8.5 vol. % bubbled mullite, W-1000; and about 5.8 vol. graphite, grade 4434. The final porosity was about 2–5 vol. %.

Sample 2 was a comparative sample-wheel, also hot-pressed. It contained about 43.8 vol. % CBN; about 4.3 vol. % of the sol gel material; about 35.3 vol. % bond; and about 15.2 vol. % graphite, grade 4434. The wheel contained about 1.5 vol. % porosity.

A mold assembly similar to that used in examples 1 and 2 was employed here, adapted for making wheels. The total assembly was subjected to the time, pressure, and temperature regimen used in example 2.

The grinding machine was a Heald CF1 model, and the operating parameters were the same as those used in example 2, although conditions at three different material removal rates (MMRs) were measured. The results are set forth in Table 3:

TABLE 3

| | MRR* (in³/min.in.) | | | | | |
|---|---|---|---|---|---|---|
| | 0.33 | | 0.65 | | 1.30 | |
| OD Mode[a] | G** | P** | G | P | G | P |
| Sample 1 | 1952 | 5.0 | 1299 | 7.8 | 532 | 10.7 |
| Sample 2*** | 1537 | 5.0 | 1101 | 7.6 | 489 | 10.9 |

*"MMR" = material removal rate;
**"G" = G-Ratio, final value;
"P" = power, in HP/in units;
***Control sample;
[a]"OD" = outer diameter of workpiece.

The data of Table 3 demonstrate considerable improvement in G-Ratio values when using an extender agent according to the present invention (sample 1), as compared to the use of only graphite (sample 2). Power consumption for both samples was roughly the same. In terms of "grindability" (G-Ratio divided by specific energy), sample 1 clearly represented an improvement over sample 2.

Other modifications and variations of this invention are possible in view of the description thus provided. It should be understood, therefore, that changes may be made in the particular embodiments shown which are within the scope of the invention defined in the appended claims.

All of the patents and articles mentioned above are incorporated herein by reference.

I claim:

1. A hot-pressed, vitrified abrasive body having total porosity in the range of about 1% to about 50%, based on volume, said body comprising:

(a) an abrasive material;

(b) a vitreous bond; and (c) an extender agent selected from the group consisting of:

(I) hollow ceramic bodies ((c)(I)); and (II) a combination of (c)(I) with at least one nonreactive material having a low coefficient of friction, which is not hollow.

2. The abrasive body of claim 1, wherein component (a) is a superabrasive material.

3. The abrasive body of claim 2, wherein the superabrasive material is selected from the group consisting of diamond and cubic boron nitride.

4. The abrasive body of claim 1, wherein component (a) comprises a sol-gel alumina abrasive.

5. The abrasive body of claim 1, wherein the vitreous bond material of component (b) comprises a glass flit.

6. The abrasive body of claim 1, wherein component (c)(I) comprises hollow mullite bodies.

7. The abrasive body of claim 6, wherein the hollow mullite bodies are spheres having an average diameter in the range of about 50 micrometers to about 150 micrometers.

8. The abrasive body of claim 1, wherein component (c)(I) comprises hollow glass bodies.

9. The abrasive body of claim 8, wherein the glass bodies are spheres having an average diameter of about 10 micrometers to about 200 micrometers; and having a maximum working pressure in the range of about 1000 psi to about 3500 psi;

10. The abrasive body of claim 1, wherein component (c)(I) is present in an amount in the range of about 2 to about 50 volume %, based on the total volume of component (b) and component (c)(I).

11. The abrasive body of claim 1, wherein component (c)(II) is a material selected from the group consisting of graphite, hexagonal boron nitride, molybdenum disulfide, and mixtures thereof.

12. The abrasive body of claim 11, wherein component (c)(II) is present in an amount in the range of about 1 to about 50 volume %, based on the total volume of component (b) and component (c)(II).

13. The abrasive body of claim 11, wherein component (c)(II) is flake graphite having an average particle size of less than about 200 micrometers.

14. The abrasive body of claim 13, wherein component (c)(I) comprises hollow mullite bodies.

15. A hot-pressed, vitrified abrasive body having total porosity in the range of about 1% to about 50%, based on volume percent, said body comprising:

(a) a superabrasive material;

(b) a vitreous bond; and (c) an extender agent combination comprising:

(i) hollow ceramic bodies of mullite or glass; and (ii) a non-hollow material selected from the group consisting of graphite, hexagonal boron nitride, molybdenum disulfide, and mixtures thereof.

16. A method of preparing a vitrified abrasive body, comprising the steps of:

(a) combining an abrasive material, a vitreous bond, and an extender agent selected from the group consisting of:

(I) hollow ceramic bodies; and (II) a combination of I with at least one nonreactive material having a low coefficient of friction, which is not hollow, to form a mixture; and then (b) thermally treating the mixture by a hot pressing technique.

17. The method of claim 16, wherein the extender agent comprises a combination of hollow mullitc bodies and a material selected from the group consisting of graphite, hexagonal boron nitride, molybdenum disulfide, and mixtures thereof.

18. The method of claim 17, wherein the hot pressing technique is carried out at a temperature of about 550° C. to about 1000° C. and a molding pressure of about 0.7 tsi to about 1.5 tsi.

19. The method of claim 18, wherein the hot pressing technique temperature and molding pressure are maintained for about 3 minutes to about 20 minutes.

20. A vitrified abrasive grinding tool prepared by the method of claim 16.

* * * * *